340-566 SR
7/7/87 OR 4,679,033

United States Patent [19]
Hwang

[11] Patent Number: 4,679,033
[45] Date of Patent: Jul. 7, 1987

[54] STRUCTURE OF VIBRATION SENSOR

[76] Inventor: Shih-Ming Hwang, No. 11, Alley 12, Lane 7, Ching-Tyan St., Taipei, Taiwan

[21] Appl. No.: 840,851

[22] Filed: Mar. 18, 1986

[51] Int. Cl.[4] ..... H01H 35/02; H01H 35/14
[52] U.S. Cl. ..... 340/566; 340/689; 200/61.52; 200/61.45 R
[58] Field of Search ..... 73/652; 340/566, 689; 200/61.45 R, 61.52, 52

[56] References Cited

U.S. PATENT DOCUMENTS 3,070,675 12/1962 Domek ..... 200/61.45 R
3,504,533 4/1970 Rodewalt ..... 73/652
3,710,051 1/1973 Orlando ..... 200/61.45 R
3,731,022 5/1973 Loftus ..... 200/61.45 R
3,786,469 1/1974 Massaro ..... 340/556

*Primary Examiner*—Howard A. Birmiel
*Attorney, Agent, or Firm*—Lane and Aitken

[57] ABSTRACT

A new structure of vibration sensor mainly comprising two metal conducting plates on its body, one of which is installed with an adjusting screw and the other with a fixing screw connecting to a vibrating spring which is connected to a hopper conductor at the other end. The adjusting screw is located in such a manner that its tip is in the middle of the hopper conductor, so that when the vibrating spring detects shock signals it causes contact between the hopper conductor and the adjusting screw.

2 Claims, 2 Drawing Figures

STRUCTURE OF VIBRATION SENSOR

BACKGROUND OF THE INVENTION

Generally, a conventional vibration sensor uses a tiny spring between a conductor and a metal conducting plate so that the spring can cause the conductor to contact with the tip of a screw when the sensor is vibrated, thus forming a contact which triggers an alarm that will give a warning signal. The tiny spring so used is an ordinary spring which does not vibrate well and since contact may occur, the warning signal is not reliable enough.

In view of such a defect, the inventor has created a new structure of vibration sensor which applies a symmetrical vibrating spring in a vertical position. The further the distance from the middle of the vibrating spring, the smaller the diameter. Whenever the vibrating spring vibrates upon any external force, the hopper conductor above the vibrating spring moves evenly without any false signal so that a proper alarm signal can be given.

SUMMARY OF THE INVENTION

The vibration sensor according to the present invention comprises a body, two metal conducting plates, an adjusting screw, an elastic element, a hopper conductor and a vibrating spring. The adjusting screw is completed with an elastic element and is fixed to the upper metal conducting plate. The vibrating spring is fixed between the lower metal conducting plate and the hopper conductor so that after installing the upper and lower metal conducting plates to the body, the adjusting screw is just in the middle of the hopper conductor but does not contact it. When the vibration sensor is subject to abnormal shock, the hopper conductor oscillates so that it contacts with the tip of the adjusting screw, forming a contact which triggers an alarm circuit for a warning signal.

DESCRIPTION OF THE PREFERRED EMBODIMENT

Figure 1:
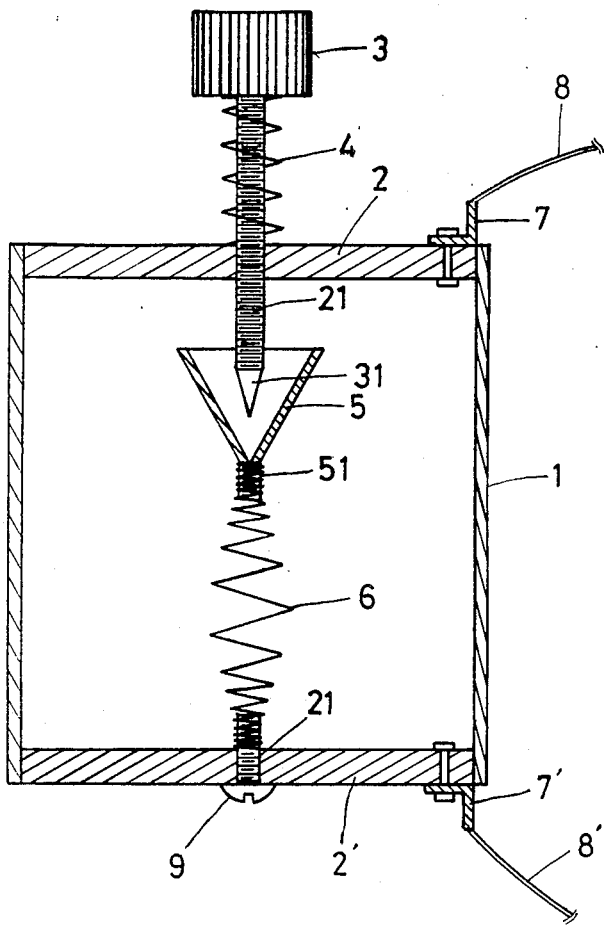
FIG. 1 is a sectional view of a preferred embodiment of the present invention.
Figure 2:
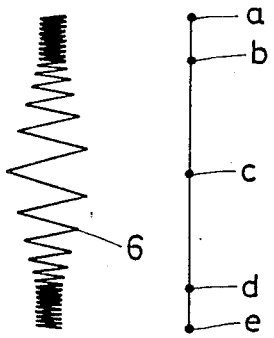
FIG. 2 illustrates a vibrating spring according to the present invention. de

FIG. 1 is a sectional view of a preferred embodiment of the present invention. FIG. 2 illustrates a vibration spring according to the present invention. The vibration sensor according to the present invention comprises a body (1), two metal conducting plates (2) and (2'), an adjusting screw (3), an elastic element (4), a hopper conductor (5), a vibrating spring (6) and a fixing screw (9). The vibrating spring (6) is fixed at a screw hole (21') in the metal conducting plate (2') by means of a the fixing screw (9). Another end of the vibrating spring (6) is connected to the thread (51) of the hopper conductor (5) so that the hopper conductor (5) is positioned in the middle of the body (1). The metal conducting plate (2) has a screw hole (21) connecting the adjusting screw (3) completed with the elastic element (4) in such a manner that the tip (31) of the adjusting screw is extending into the hopper conductor (5) but does not contact with the hopper conductor (5) Terminals (7) and (7') and connecting wires (8) and (8') are fixed to the metal conducting plates (2) and (2') respectively.

When abnormal force has caused the vibration sensor to vibrate, the hopper conductor (5), because of its inertia and elasticity, vibrates upwards, downwards, left, right or circularly following vibration of the vibration sensor. It will then contact with the tip (31) of the adjusting screw (3) and together with the wires connecting the respective metal conducting plates (2) and (2') form a contact to trigger an alarm circuit for a warning signal.

FIG. 2 illustrates a vibrating spring according to the present invention. The point c is the central point of the vibrating spring (6). The further the distance from the central point c, the denser the winding. Sections bc and dc are symmetrical. Such a structure makes the vibrating spring (6) more tensile. In other words, after fixing the points a and b to the hopper conductor (5) and the points d and e to the fixing screw (9), the hopper conductor (6) is supported within the body (1) and it is very sensitive to external force applied to the body. Therefore, it can detect even transient shock signals.

The vibrating spring (6) is a symmetrical structure in a vertical position. The further the distance, from the middle of the spring, the denser the winding, and the smaller the diameter. Therefore, the spring can vibrate evenly and eliminate false signals. Use of the elastic element around the adjusting screw (3) is to prevent looseness of the adjusting screw (3).

The vibration sensor according to the present invention does not only detect upward and downward vibration. It can be installed on automobiles, motorcycles and/or in any other place and trigger an alarm circuit whenever it detects any improper shock. Its sensitivity is adjustable by adjusting the distance between the tip (31) of the adjusting screw (3) and the hopper conductor (5) to adapt to requirements in various applications and to avoid malfunction.

I claim:

1. A base, an electrically conductive hopper, a spring in the form of a winding extending between said hopper and said base and supporting said hopper over said base, an electrically conducting element extending into said hopper without touching said hopper when said spring is in an equilibrium position at rest, said winding of said spring having its greatest diameter at a middle point of said spring between said hopper and said base and decreasing in diameter proceeding from said middle point toward said hopper and said base, said winding having its least density at said middle point and increasing in density proceeding from said middle point to said hopper and said base.

2. A vibration sensor as recited in claim 1, wherein said base is a metal conducting plate, said electrically conductive element is an adjusting screw mounted in a second metal conducting plate, and extending into said hopper, an elastic element mounted on said adjusting screw to maintain it tightly in position on said second conducting plate, a fixing screw fixing one end of said spring to said first conducting plate, and a body surrounding said spring and said hopper extending between said first and second conducting plates.

* * * * *